US010427812B2

(12) United States Patent
Niu

(10) Patent No.: US 10,427,812 B2
(45) Date of Patent: Oct. 1, 2019

(54) ALL-MODEL ALUMINUM PRODUCT AUTOMATIC PACKING MACHINE

(71) Applicant: GUANGDONG JMA ALUMINIUM PROFILE FACTORY (GROUP) CO., LTD., Foshan (CN)

(72) Inventor: Decai Niu, Foshan (CN)

(73) Assignee: GUANGDONG JMA ALUMINIUM PROFILE FACTORY (GROUP) CO., LTD., Foshan (CN)

( * ) Notice: Subject to any disclaimer, the term of this patent is extended or adjusted under 35 U.S.C. 154(b) by 370 days.

(21) Appl. No.: 15/316,129

(22) PCT Filed: May 20, 2015

(86) PCT No.: PCT/CN2015/079345
§ 371 (c)(1),
(2) Date: Dec. 2, 2016

(87) PCT Pub. No.: WO2015/188680
PCT Pub. Date: Dec. 17, 2015

(65) Prior Publication Data

US 2017/0113822 A1 Apr. 27, 2017

(30) Foreign Application Priority Data

Jun. 9, 2014 (CN) ..... 2014 1 0250332

(51) Int. Cl.
*B65B 11/04* (2006.01)
*B65B 35/40* (2006.01)
(Continued)

(52) U.S. Cl.
CPC ..... *B65B 11/04* (2013.01); *B65B 35/40* (2013.01); *B65B 41/16* (2013.01); *B65B 51/02* (2013.01);
(Continued)

(58) Field of Classification Search
CPC ..... B65B 11/04; B65B 11/14; B65B 35/40; B65B 41/16; B65B 67/08
See application file for complete search history.

(56) References Cited

U.S. PATENT DOCUMENTS 4,461,136 A * 7/1984 Hudson ..... B65B 11/04 53/211
5,546,729 A * 8/1996 Pienta ..... B65B 11/04 53/136.2

FOREIGN PATENT DOCUMENTS

CN 1736801 A 2/2006
CN 102700742 A 10/2012
(Continued)

OTHER PUBLICATIONS

International Search Report for PCT/CN2015/079345 dated Aug. 5, 2015 and its English machine translation provided by WIPO.
(Continued)

*Primary Examiner* — J C Jacyna
(74) *Attorney, Agent, or Firm* — Anova Law Group, PLLC

(57) ABSTRACT

An all-model aluminum product automatic packing machine, comprises: a rack (1), a packing mechanism (2) disposed on the rack (1), and a feeding mechanism (3) for delivering an aluminum product to the packing mechanism (2). The packing mechanism (2) comprises universal clamps (4) symmetrically disposed at two ends of the rack (1); the universal clamps (4) fix one end of the aluminum product, and rotates under the driving of a rotating motor (5), and stretches and retracts under the driving of the pneumatic push rod (6). The rack (1) is provided with a packing platform (7) thereon; and one side of the packing platform (7) corresponding to the universal clamp (4) is provided with a pressing piece (8) capable of turning upward. The packing machine realizes linear automatic packing of all-model
(Continued)

aluminum products, improves packing quality and packing efficiency, and saves labor and energy.

8 Claims, 4 Drawing Sheets

(51) Int. Cl.

| | |
|---|---|
| ***B65B 41/16*** | (2006.01) |
| ***B65B 51/02*** | (2006.01) |
| ***B65B 61/00*** | (2006.01) |
| ***B65B 61/28*** | (2006.01) |
| ***B65B 65/02*** | (2006.01) |
| ***B65B 67/08*** | (2006.01) |

(52) U.S. Cl.
CPC ..... *B65B 61/005* (2013.01); *B65B 61/28* (2013.01); *B65B 65/02* (2013.01); *B65B 67/08* (2013.01)

(56) References Cited

FOREIGN PATENT DOCUMENTS

| | | | |
|---|---|---|---|
| CN | 202703972 | U | 1/2013 |
| CN | 103332346 | A | 10/2013 |
| CN | 103625681 | A | 3/2014 |
| CN | 203461188 | U | 3/2014 |
| CN | 203558237 | U | 4/2014 |
| CN | 104044762 | A | 9/2014 |
| CN | 203958662 | U | 11/2014 |
| JP | 11245910 | A | 9/1999 |
| JP | H11245910 | | 9/1999 |
| KR | 100515443 | B1 | 9/2005 |
| WO | 2012113390 | A2 | 8/2012 |

OTHER PUBLICATIONS

Written Opinion for PCT/CN2015/079345 dated Aug. 5, 2015 and its English machine translation provided by Google Translate.
First Search of the State Intellectual Property Office of the P.R.C. for application No. 201410250332.5.
First Office Action and English translation of the State Intellectual Property Office of the P.R.C. for application No. 201410250332.5.
First Search of the State Intellectual Property Office of the P.R.C. for application No. 201310584192.0.
First Office Action and English translation of the State Intellectual Property Office of the P.R.C. for application No. 201310584192.0.
Written Opinion for PCT/CN2015/079345, dated Aug. 5, 2015, and its English translation provided by WIPO.
International Preliminary Report on Patentability (Chapter 1) for PCT/CN2015/079345, dated Dec. 15, 2016, and its English translation provided by WIPO.

* cited by examiner

ALL-MODEL ALUMINUM PRODUCT AUTOMATIC PACKING MACHINE

CROSS-REFERENCE TO RELATED APPLICATIONS

The present application is the U.S. national phase of PCT Application PCT/CN2015/079345 filed on May 20, 2015, which claims priority to the Chinese patent application No. 201410250332.5 filed on Jun. 9, 2014 which are incorporated herein by reference in their entireties.

TECHNICAL FIELD OF THE INVENTION

The present invention relates to a packaging machine, particularly relates to an all-model aluminum product automatic packing machine.

TECHNICAL BACKGROUND OF THE INVENTION

In the field of aluminum products production, the aluminum products are needed to be packed in order to protect the aluminum products during transportation from being scratched.

At present, the aluminum products are mainly packed by spirally winding wrapping paper, which only has few technological requirements, but the overlapped portion of the wrapping paper is quite large and takes quite a long time for packing, thus consumes quantity of wrapping paper resources and is harmful to the environment.

At present, linear covering packing technology is still under developing, and the linear covering packing machinery is expensive, thus difficult to be deployed in the workshop. Therefore, there is an urgent need to provide a linear covering packing technology, which can realize the automatic packing of the all-model aluminum product utilizing the automatic rotating of the aluminum products together with the pressing piece, filling a gap in the international technology.

SUMMARY OF THE INVENTION

The technical problems to be solved by the present invention are to provide an all-model aluminum product automatic packing machine, which can automatically pack the aluminum products with irregular cross-sections. And the machine has high efficiency and good quality and consumes less labor and less packing cost.

To overcome the above technical problems, the present invention provides an all-model aluminum product automatic packing machine, comprising: a rack, a packing mechanism disposed on the rack, and a feeding mechanism for delivering aluminum products to the packing mechanism; the packing mechanism comprises universal clamps symmetrically disposed at two ends of the rack, the universal clamps is used to fix the aluminum products, the universal clamps rotate under the driving of a rotating motor and stretch forward and retract backward under the driving of a pneumatic push rod; the rack is provided with a packing platform thereon; and one side of the packing platform corresponding to the universal clamps is provided with a pressing piece capable of turning upward.

As an improvement of the above scheme, the universal clamps are metal plates, and their surfaces towards the aluminum products are covered with rubber layers.

As an improvement of the above scheme, the universal clamps are metal plates, and their surfaces towards the aluminum products are provided with stretchable positioning rods; the positioning rods are spaced from each other and cover the surface of the universal clamp.

As an improvement of the above scheme, the pressing piece comprises flat and long blocks which abut to each other, one end of each of the flat and long block sleeve connects with a turning rod, each of the flat and long block is provided with a turning clutch for fixing the flat and long block with the turning rod at the location sleeve connecting with the turning rod; the turning rod drive the pressing piece to turn upwards under the driving of a turning motor; the turning clutch switch between a locked state and a opened state matched with a level, the level is located under the turning clutch, and stretches forward and retracts backward synchronized with the universal clamps.

As an improvement of the above scheme, the feeding mechanism comprises a feeding platform disposed at a feeding side of the rack; at least two sets of feeding pushing boards are disposed at the front end of the feeding platform; the pushing boards are connected to a feeding pneumatic cylinder, and stretch forward and retract backward horizontally under the driving of the feeding pneumatic cylinder.

As an improvement of the above scheme, the feeding platform is provided with a height and width adjusting switch at the position corresponding to the respective feeding pushing boards, the height and width adjusting switch is used to control the aluminum products on the feeding pushing boards to keep vertical to the surface of the universal clamps.

As an improvement of the above scheme, further comprises a paper-delivering mechanism, the paper-delivering mechanism comprising a feeding roller, a cutter, and a glue roller; the feeding roller is used for driving the wrapping paper forward; the glue roller is used for coating the upper surface of the two sides of the wrapping paper with glue; the cutter is disposed at the paper outlet of the paper-delivering mechanism and is used for cutting off the wrapping paper.

As an improvement of the above scheme, the paper-delivering mechanism further comprises a paper-pulling clip with one end fixedly connected to the packing mechanism, the paper-pulling clip comprises a chuck and a paper-pulling pneumatic cylinder connected to the chuck.

As an improvement of the above scheme, both of the packing mechanism and the paper-delivering mechanism are disposed on a sliding rail at one side of the rack, and slide along the sliding rail.

As an improvement of the above scheme, further comprises a discharging mechanism, the discharging mechanism comprises a discharging outlet disposed on the packing platform, with a supporting frame disposed at the discharging outlet, the supporting frame is hinge jointed with the rack via a swing lever, and an arc shaped discharging rail is disposed below the discharging outlet.

Embodiments of the present invention have the following advantageous effects:

The present invention utilizes the universal clamps to fix and thus rotate and pack the aluminum products, and utilizes the pressing piece to press the wrapping paper tightly against the surface of aluminum products, therefore overcomes the problem of wrapping around the aluminum products with irregular cross-section. The all-model aluminum product automatic packing machine can pack all-model aluminum products automatically, enhance the packing efficiency and packing quality, and save energy and manpower.

DESCRIPTION OF FIGURES OF THE INVENTION

DETAILED DESCRIPTION OF EMBODIMENTS OF THE INVENTION

To make the aim, solutions and advantages of the present invention more clear, the invention is further described in detail as below in conjunction with the accompanying drawings.

Figure 1:
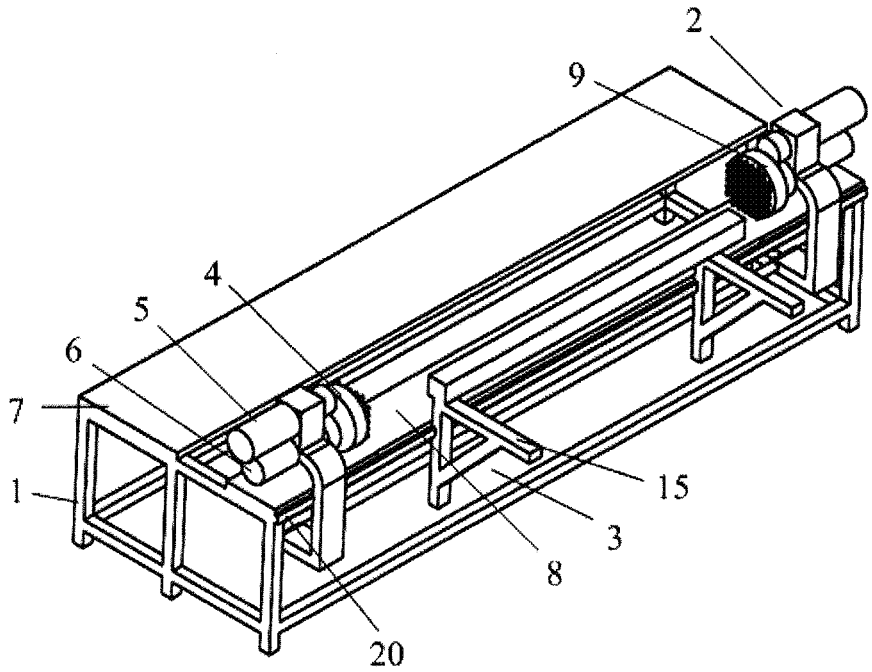
FIG. 1 is a schematic drawing of the all-model aluminum product automatic packing machine of the present invention.

As shown in FIG. 1, the first embodiment of the present invention provides an all-model aluminum product automatic packing machine. The automatic packing machine comprises a rack 1, a packing mechanism 2 disposed on the rack 1, and a feeding mechanism 3 for delivering the aluminum products to the packing mechanism 2. The packing mechanism 2 comprises universal clamps 4 symmetrically disposed at two ends of the rack 1 for fixing the aluminum products. The universal clamps 4 can rotate under the driving of a rotary motor 5, and can stretch and retract under the driving of a pneumatic push rod 6. The rack 1 is provided with a packing platform 7 thereon; one side of the packing platform 7 corresponding to the universal clamp 4 is provided with a pressing piece 8 capable of turning upward.

It should be noted that the present invention utilizes the universal clamps 4 to fix and thus rotate and pack aluminum products, and utilizes the pressing piece 8 to press the wrapping paper tightly against the surface of aluminum products, therefore overcomes the problem of covering packing of the aluminum products with irregular cross-section. The all-model aluminum product automatic packing machine can pack all-model aluminum products, enhance the packing efficiency and packing quality, and save energy and manpower.

It should be noted that the universal clamps 4 in the embodiment fix the aluminum products by pressure from the two universal clamps 4 disposed at two ends of the rack 1, the deformation and friction of the rubber layer. Specifically, once the aluminum products are delivered to the predetermined position of the universal clamps 4, the universal clamps 4 stretch out towards the aluminum products to clamp the aluminum products. Meanwhile the rubber layer is deformed because of pressure, and thus the aluminum products are caught in the rubber layer, the rubber layer enfolds the ends of the aluminum products, and keeps the aluminum products fixed relative to the universal clamps 4.

In the first embodiment, the universal clamp 4 is a metal plate 9, and the surface towards the aluminum products is covered with a rubber layer (the rubber layer is not shown in the figures).

Figure 4:
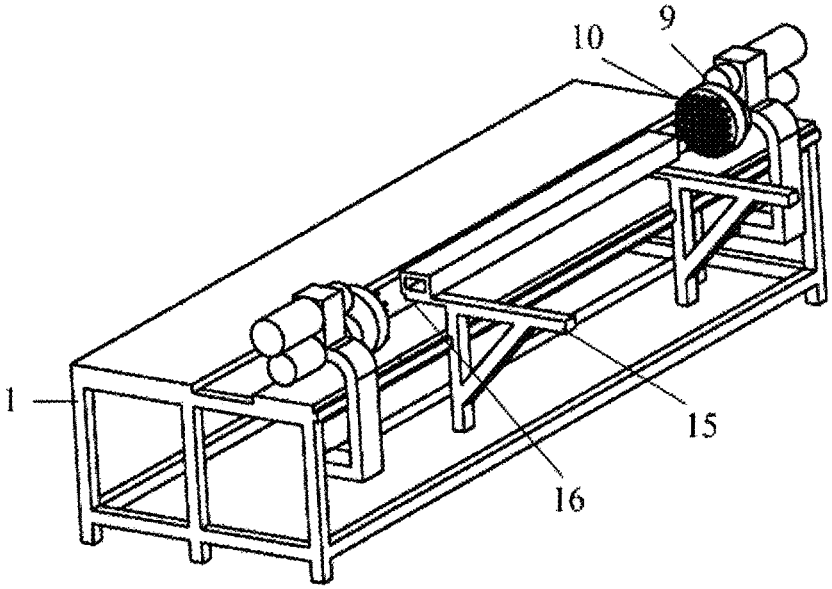
FIG. 4 is the schematic drawing of the working principle of the feeding platform of the present invention.
Figure 5:
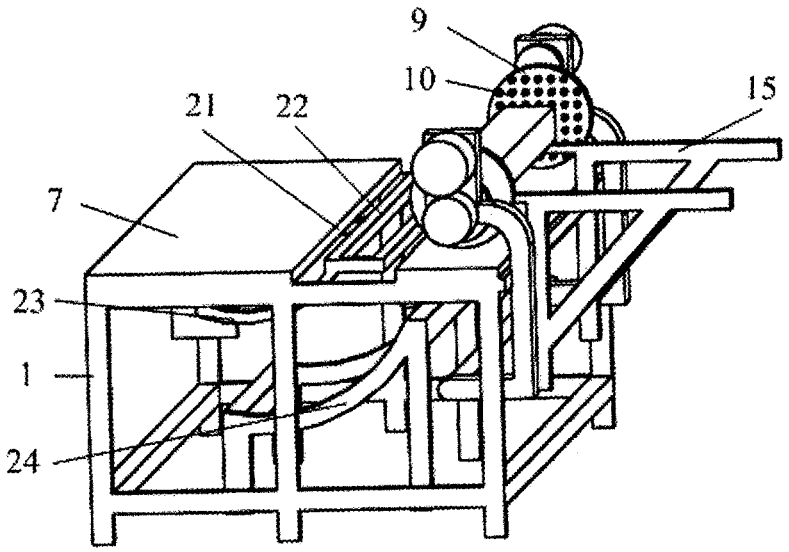
FIG. 5 is the schematic drawing of the working principle of the discharging mechanism of the present invention.

As shown in FIG. 4 and FIG. 5, the differences between the second embodiment and the first embodiment of the present invention are, the universal clamp 4 is a metal plate 9, and is provided with positioning rods 10 on its end towards the aluminum products. The positioning rods 10 are spaced a certain distance from each other and cover the whole area of the surface of the end of the metal plate 9. Each of the positioning rods is provided with a spring at its bottom. The metal plate 9 is provided with grooves inside it for the movement of the positioning rods 10. The springs keep the positioning rods 10 extending outward without being pressed. When the springs are pressed towards the grooves, the positioning rods 10 draw back into the metal plate 9.

It should be noted that for the aluminum products with irregular cross-section, the end surfaces of the aluminum products will press the positioning rods 10 at the corresponding location into the metal plate 9, and the remaining positioning rods 10 surround and lock the ends of the aluminum products, and thus fix and rotate the aluminum products of different model. Relative to the manner using the rubber layer in the first embodiment, fixing the aluminum products by the positioning rods 10 in the second embodiment only needs smaller pushing force directing to the axis of the aluminum products, so as to prevent the aluminum products from deforming because of over-large pressure during loading and clamping, and reduce the pressure requirement of the device, such as the input air pressure, etc.

Figure 2:
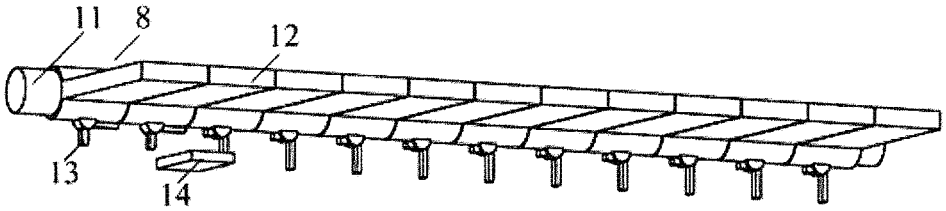
FIG. 2 is the schematic drawing of the pressing piece of the present invention at the initial state.
Figure 3:
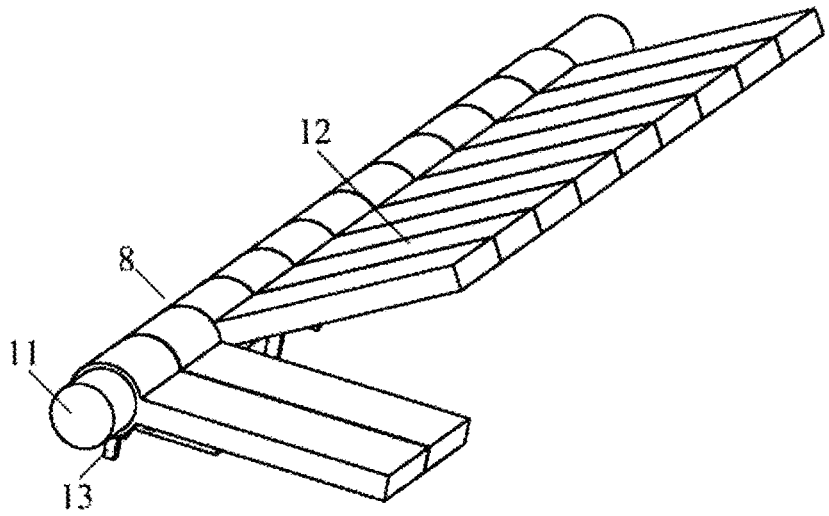
FIG. 3 is the schematic drawing of the pressing piece of the present invention in the turning state.

Preferably, as shown in FIG. 2 and FIG. 3, the pressing piece 8 comprises flat and long blocks 12 which abut to each other. One end of the flat and long block 12 sleeve connects with a turning rod 11. Each of the flat and long block 12 is provided with a turning clutch 13 for fixing the flat and long blocks 12 with the turning rod 11 at the location sleeve connecting with the turning rod 11. The turning rod 11 can drive the pressing piece 8 to turn upwards under the driving of a turning motor (no shown in the figures). The turning clutch 13 can switch between the locked state and the opened state matched with a level 14. The level 14 is located under the turning clutch 13, and stretches forward and retracts backward synchronized with the universal clamps 4.

It should be noted that because of the structure of the pressing piece 8, the pressing piece 8 can automatically adjust its physical length as required, so that the aluminum products with different lengths can be pressed tightly by the pressing piece 8 when being packed. Specifically, in the beginning, the flat and long blocks 12 are fixed with the turning rod 11 by the turning clutch 13, and all the flat and long blocks 12 can turn upwards with the rotation of the turning rod 11. The flat and long blocks 12 will contact with the aluminum products being packed when the flat and long blocks 12 being turned to a position, and press the aluminum products tightly against the wrapping paper. If aluminum products are relatively shorter, the lever 14 will move with the stretching forward and retracting backward of the universal clamp 4, and thus open the turning clutches 13 on the way. Then, the flat and long blocks 12 with the corresponding turning clutches 13 opened will not turn with the turning rod 11, thus the turning upwards length of the pressing piece 8 can be kept the same with the length of the aluminum products.

To grantee that the pressing piece 8 can press tightly against the aluminum products, the pressing piece 8 is provided with an elastic layer (not shown in the figures) on its surface, and specifically, the elastic layer is made of sponge fabric.

Preferably, the feeding mechanism 3 comprises a feeding platform 15 disposed at the feeding side of the said rack 1. At least two sets of feeding pushing boards 16 are disposed at the front end of the feeding platform 15; the feeding pushing boards 16 are connected to a feeding pneumatic cylinder, and can stretch forward and retract backward horizontally under the driving of the feeding pneumatic cylinder.

Preferably, the feeding platform 15 is provided with a height and width adjusting switch (not shown in the figures) at the position corresponding to the respective feeding pushing boards 16. The height and width adjusting switch is used to control the aluminum products on the feeding pushing boards 16 to keep vertical to the surface of the universal clamps 4. The height and width adjusting switch may be the switch known in the art.

It should be noted that the feeding platform 15 can automatically deliver the aluminum products to proper positions suitable for the aluminum products to be clamped by the universal clamps 4 matched with the conveying belt known in the art. Specifically, when feeding the aluminum products, the aluminum products can be delivered to the feeding pushing boards 16 by the conveying belt. And then the aluminum products can be delivered to the predetermined position by the feeding pushing boards 16. When feeding the aluminum products, for some reasons, the aluminum products cannot keep parallel with the rack 1 when the feeding pushing boards 16 is at its initial position, as a result, the universal clamps 4 cannot fix the aluminum products tightly. Therefore, the feeding platform 15 is provided with a height and width adjusting switch at the position corresponding to the respective feeding pushing boards 16, the height and width adjusting switch is used to control the aluminum products on the feeding pushing boards 16 to keep vertical to the surface of the universal clamps. While the feeding pushing board 16 pushes the aluminum products forward, the corresponding height and width adjusting switch must be in a connected state under the influence of the aluminum products. If the height and width adjusting switch on one side is in a no induction state, the feeding pushing board 16 on the other side will stop moving forward and wait the feeding pushing board 16 on the side with the no induction state to continue to move forward. When the height and width adjusting switch in the no induction state begins to be induced, the feeding pushing board 16 on the other side will continue to feeding the aluminum products forward, to guarantee the aluminum products keeping vertical to the universal clamps 4.

Preferably, the automatic packing machine further comprises a paper-delivering mechanism (not shown in the figures). The paper-delivering mechanism comprises a feeding roller, a cutter, and a glue roller. The feeding roller is used for driving the wrapping paper forward. The glue roller is used for coating the upper surface of the two sides of the wrapping paper with glue. The cutter is disposed at the paper outlet of the paper-delivering mechanism, for cutting off the wrapping paper.

Figure 6:
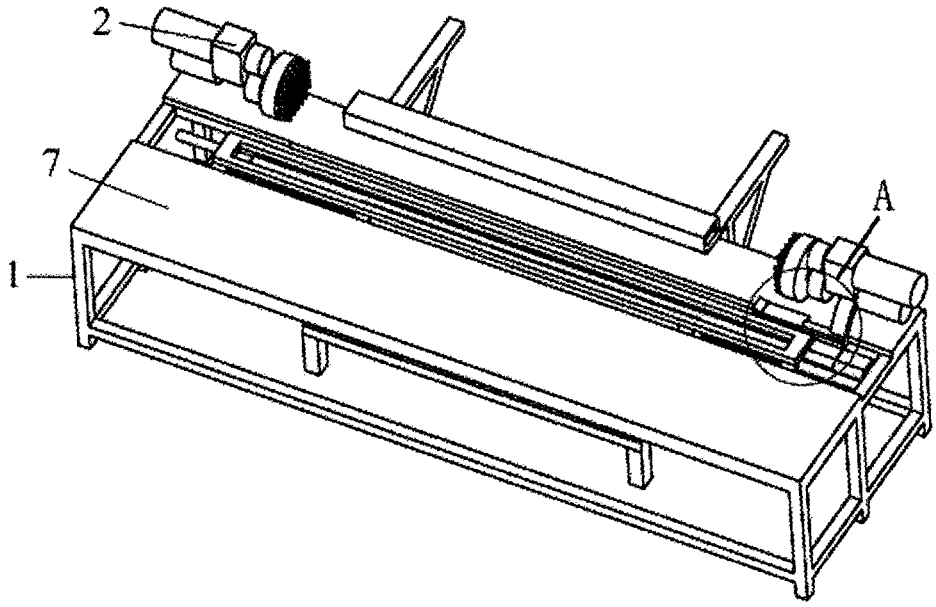
FIG. 6 is another schematic drawing of the all-model aluminum product automatic packing machine of the present invention.
Figure 7:
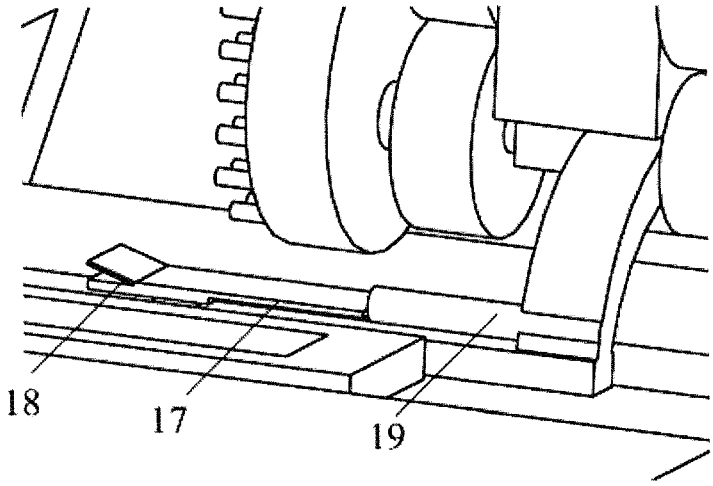
FIG. 7 is an enlarged view of portion A of FIG. 6.

Preferably, as shown in FIG. 6 and FIG. 7, the paper-delivering mechanism further comprises a paper-pulling clip 17 with one end fixedly connected to the packing mechanism 2. The paper-pulling clip 17 comprises a chuck 18, and a paper-pulling pneumatic cylinder 19 connected to the chuck 18.

It should be noted that a portion of the wrapping paper sent to the packing platform 7 by the paper-delivering mechanism may be curved, which will lower the package quality therefore. The paper-pulling clip 17 can clamp the terminal of the wrapping paper after the paper are delivered, and the paper-pulling pneumatic cylinder 19 can push the chuck 18 backward, so that the wrapping paper can spread on the packing platform 7.

Preferably, both of the packing mechanism 2 and the paper-delivering mechanism are disposed on a sliding rail 20 at one side of the rack, and can slide along the sliding rail 20.

It should be noted that both of the packing mechanism 2 and the paper-delivering mechanism are disposed on a sliding rail 20 at one side of the rack, and can slide along the sliding rail 20. The packing mechanism 2 and the paper-delivering mechanism can be adjusted according to the length of the aluminum products to be packed, with good adaptability.

Preferably, as shown in FIG. 5, the automatic packing machine further comprises a discharging mechanism. The discharging mechanism comprises a discharging outlet 21 disposed on the packing platform 7, with a supporting frame 22 disposed at the discharging outlet 21. The supporting frame 22 is hinge jointed with the rack 1 via a swing lever 23. An arc shaped discharging rail 24 is disposed below the discharging outlet 21.

It should be noted that the supporting frame 22 is used for supporting the wrapping paper. When discharging, the discharging can be facilitated by turning the swing lever 23 to a position under the packing platform 7. The packed aluminum products fall into the discharging rail 24 through the discharging outlet 21, and delivered to a storage location guided by the discharging rail 24.

The present all-model aluminum product automatic packing machine will be illustrated in detail as below:

1. The wrapping paper spreads on the packing platform 7 after passing the paper-delivering mechanism. Then the cutter cuts off the wrapping paper. And then the two sides of the wrapping paper are coated with glue by the glue roller. And then the paper-pulling clip 17 clamps the terminal of the wrapping paper to a level state and pulls the wrapping paper to a predetermined position.

2. The aluminum products are delivered to the feeding mechanism 3 by the conveying belt, and are delivered to the predetermined position by the feeding pushing boards 16, and being kept vertical to the universal clamps 4.

3. The pneumatic push rod 6 of the universal clamps 4 pushes out the universal clamps 4; and the universal clamps 4 clamp the aluminum products tightly.

4. The universal clamps 4 rotate under the driving of the rotating motor 5, and the pressing piece 8 begins to turn upwards.

5. The pressing piece 8 presses the wrapping paper tightly against the aluminum products. Then one side of the wrapping paper is stuck to the aluminum products tightly, and rotates together with the aluminum products.

6. The wrapping paper fully covers the aluminum products, and then the edge of the other side of the wrapping paper is stuck to the wrapping paper in the internal layer. The packing is now finished.

7. The supporting frame 22 swings to a position under the packing platform 7. Then the universal clamps 4 retract backward and loose the aluminum products. The packed aluminum products fall into the discharging outlet 21 because of gravity, and roll to the predetermined storage location guided by the discharging rail 24.

The above disclosed solutions are only preferred embodiments of the present invention, which are not intended to limit the protection scope of the present invention. Therefore, any equivalent changes made according to the claims of present invention are still in the scope of the present invention.

INDUSTRIAL APPLICABILITY OF THE INVENTION

In the present invention, the aluminum products are fixed and rotated and packed by using the universal clamps, and the wrapping paper are pressed against the surface of the aluminum products tightly by using the pressing piece. In such way, the problems of packing the aluminum products of irregular cross-section are overcame, and the automatic linear packing of all-model aluminum product can be realized, improving the packing efficiency and packing quality, and saving energy and labor.

The invention claimed is:

1. An automatic packing machine, comprising:
- a rack;
- a packing mechanism disposed on the rack; and
- a feeding mechanism configured to deliver aluminum products to the packing mechanism;

wherein:
- the packing mechanism comprises universal clamps symmetrically disposed at two ends of the rack and being configured to fix the aluminum products, the universal clamps being further configured to:
  - rotate under driving of a rotating motor, and
  - stretch forward and retract backward under driving of a pneumatic push rod; and
- the rack includes a packing platform, and the packing platform includes a pressing piece provided at one side of the packing platform corresponding to the universal clamps and capable of turning upward.

2. The automatic packing machine according to claim 1, wherein the universal clamps include metal plates, and surfaces of the universal clamps are covered with rubber layers.

3. The automatic packing machine according to claim 1, wherein the universal clamps include metal plates, stretchable positioning rods are arranged at surfaces of the universal clamps, and the positioning rods are spaced apart from each other and cover the surfaces of the universal clamps.

4. The automatic packing machine according to claim 1, wherein:
- the pressing piece comprises flat and long blocks abutting each other;
- one end of each of the flat and long block sleeve connects with a turning rod;
- each of the flat and long block includes a turning clutch provided at a location at which the flat and long block connects with the corresponding turning rod, the turning clutch being configured to fix the flat and long block with the turning rod; and
- the turning rod is configured to:
  - drive the pressing piece to turn upwards under driving of a turning motor;
  - switch between a locked state and an opened state matched with a level located under the turning clutch; and
  - stretch forward and retract backward in synchronization with the universal clamps.

5. The automatic packing machine according to claim 1, wherein the feeding mechanism comprises:
- a feeding platform disposed at a feeding side of the rack;
- at least two sets of feeding pushing boards disposed at a front end of the feeding platform, the pushing boards being connected to a feeding pneumatic cylinder and configured to stretch forward and retract backward horizontally under driving of the feeding pneumatic cylinder.

6. The automatic packing machine according to claim 1, further comprising:
- a paper-delivering mechanism comprising a paper-pulling clip having one end fixedly connected to the packing mechanism, the paper-pulling clip comprising a chuck and a paper-pulling pneumatic cylinder connected to the chuck.

7. The automatic packing machine according to claim 6, wherein, both of the packing mechanism and the paper-delivering mechanism are disposed on a sliding rail at one side of the rack, and are configured to slide along the sliding rail.

8. The automatic packing machine according to claim 1, further comprising:
- a discharging mechanism comprising:
  - a discharging outlet disposed on the packing platform;
  - a supporting frame disposed at the discharging outlet and hinge jointed with the rack via a swing lever; and
  - an arc shaped discharging rail disposed below the discharging outlet.

* * * * *